United States Patent [19]

Saegusa

[11] Patent Number: 4,657,492

[45] Date of Patent: Apr. 14, 1987

[54] ROTOR FOR A ROTARY PUMP

[75] Inventor: Yasuyoshi Saegusa, Itami, Japan

[73] Assignee: Sumitomo Electric Industries, Ltd., Osaka, Japan

[21] Appl. No.: 545,193

[22] Filed: Oct. 25, 1983

[30] Foreign Application Priority Data

Oct. 27, 1982 [JP] Japan ..... 57-189880

[51] Int. Cl.[4] ..... F01C 1/00

[52] U.S. Cl. ..... 418/150

[58] Field of Search ..... 418/150, 171, 178, 58, 418/61 B

[56] References Cited

U.S. PATENT DOCUMENTS

| | | | |
|---|---|---|---|
| 3,091,386 | 5/1963 | Paschke . | |
| 3,117,561 | 1/1964 | Bonavera . | |
| 3,881,847 | 5/1975 | Chen . | |
| 4,395,206 | 7/1983 | Hoffmann | 418/61 A |

OTHER PUBLICATIONS

J. R. Colbourne, The Geometry of Trochoid Envelopes and Their Application in Rotary Pumps, 1974.

*Primary Examiner*—William R. Cline
*Assistant Examiner*—Richard R. Cole
*Attorney, Agent, or Firm*—Wenderoth, Lind & Ponack

[57] ABSTRACT

A rotary gear pump having inner and outer gear rotors of the type having respective inner and outer surfaces whose cross sections are determined utilizing the trochoidal curve, the inner gear rotor having trochoidal dimensions which either eliminate or diminish to a negligible amount the edge portion of the teeth which cause excessive wear, noise or inefficiency. In one embodiment of the invention, the dimensions of the inner gear rotor are such that $C/K_0 \leqq 1$ or $f_c/K_1 \leqq 1.1$, where C is the rotary path diameter, $K_0=(A/B+1)\times|B-2e|$, $K_1=(n+1)\times|1-2f_e|$, A is the diameter of the base circle, B is the diameter of the rolling circle, e is the eccentricity, $n=A/B$, $f_e=e/B$, and $f_c=C/B$. In accordance with a second embodiment of the invention, a comparable result can be obtained provided that the number of teeth on the inner gear rotor is equal to an integer closest to the ratio $d_4/2e$, wherein $d_4$ is the minor diameter of the inner rotor.

8 Claims, 10 Drawing Figures

ROTOR FOR A ROTARY PUMP

BACKGROUND OF THE INVENTION

This invention relates to a rotor for a rotary gear pump utilizing the trochoidal curve.

It has been well known that an inner rotor curve defined by the periphery of the locus of circular arcs centered on the trochoidal curve, and a theoretical curve of an outer rotor, can be obtained when given the dimensions of a diameter of a base circle, a diameter of a rolling circle, an eccentricity, and a diameter of a rotary path.

However, the inner rotor curve according to these dimensions in prior rotors of this type becomes an inner tooth form having a duplicate portion or an edge portion so that when the rotor of such form is used directly in the pump, the bearing stress (Hertz stress) at the duplicate portion or edge portion increases to promote wear or settling thereat, thereby creating the problem in that the pump performance deteriorates so as to cause vibrations or noises. The term "duplicate portion" as used herein means a loop which may be generated in the inner rotor curve depending on the dimensions of the circles and eccentricity selected for forming the inner rotor curve, and the edge of the resulting inner rotor formed thereat.

In the light of the above problem, this invention has been designed. An object thereof is to provide a rotor for a rotary pump free from the generation of a duplicate portion or edge portion.

An inner rotor for the rotary gear pump utilizing the trochoidal curve can be obtained when a given diameter A of a base circle, diameter B of a rolling circle, an eccentricity e, and a given diameter C of a rotary path as shown in FIG. 1, are utilized to obtain an inner rotor curve TC from the periphery of the locus of circular arcs centered on the trochoidal curve T and also a theoretical curve of an outer rotor.

The inner rotor curve of the prior rotors of this type, however, becomes an inner tooth form as shown in FIG. 2A or FIG. 2B-(II) according to the selection of the above dimensions.

The tooth form in 2A infact is not realizable. In a case where the tooth form in FIG. 2B is directly used for the pump, bearing stress (Hertz stress) at the edge portion 2 in the same figure becomes larger to promote wear or settling at the edge portion 2, thereby having created the problem that the pump performance deteriorates, or vibrations or noises increase.

Therefore, the edge portion in FIG. 2B, when produced, has hitherto been corrected as shown in FIG. 3A and its enlarged view in FIG. 3B. Also, the tooth form of duplicate portion 1 has been corrected as shown in FIG. 3C.

Such correction, however, will lead to a cutout of the part of tooth form by an amount $\delta$, so that the resulting inner rotor curve, even through different to an extent from the original inner rotor curve, is quite similar to the curve where wear or settling has developed in the amount $\delta$ after use, thus having lowered the performance of the pump.

The invention is intended to overcome the above disadvantages of prior rotary gear pumps. An object of the invention is to provide a rotor for a rotary gear pump, which is free from creation of the duplicate portion or edge portion and need not be corrected.

BRIEF DESCRIPTION OF THE DRAWINGS

These and other objects of the invention will be seen by reference to the description, taken in correction with the accompanying drawings.

FIG. 3C is an enlarged view of a duplicate portion in FIG. 2A when corrected, FIG. 6 is a explanatory view of an inner rotor tooth profile, FIG. 7 is a theoretical curve of an outer rotor for use with the inner rotor, FIG. 8 is an explanatory drawing of part of FIG. 7, FIG. 9 is an explanatory drawing showing the major and minor diameters of the outer rotor tooth profile of FIG. 7, and FIG. 10 is an explanatory drawing of an inner rotor assembled in an outer rotor.

BRIEF DESCRIPTION OF THE PREFERRED EMBODIMENTS

Figure 1:
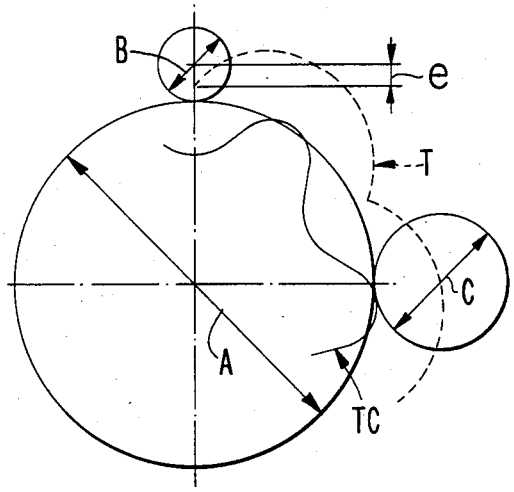
FIG. 1 is a view explanatory of dimensions for design of a rotor for a rotary pump utilizing the trochoidal curve.

In a rotary pump in which the inner and outer surfaces of the inner and outer gear rotors are defined utilizing the trochoidal curve, the periphery of the inner rotor is defined as is illustrated in FIG. 1 by first generating a trochoidal curve T as a locus of a fixed point inside the rolling circle of diameter B distanced from its center by an eccentricity e when the rolling circle is rolled on a base circle of diameter A without any slip. The outer periphery of the inner rotor (the inner rotor gear tooth shape or profile) TC can be formed in accordance with the prior art as the locus of points defined by a point on a circle of diameter C nearest the center of the base circle of diameter A as the center of the locus circle moves along the trochoidal curve T. The inner rotor will have a number of teeth equal to $n=A/B$. Referring to FIG. 6, it is well known that such a rotor will have an major diameter $d_3$ defined by:

$$d_3 = A + B - C + 2e.$$
$$= (n + 1)B - C + 2e.$$

Similarly, the minor diameter $d_4$ of the inner rotor is defined by:

$$d_4 = A + B - C - 2e.$$
$$= (n + 1)B - C - 2e.$$

Thus, it is clear that such an inner rotor tooth profile is determined by four perameters, either (A, B, C, e) or (n, B, C, e) or (n, A, C, e).

A known, theoretical outer rotor for use with the above-described inner rotor is formed utilizing the same perimeters as were used for the inner rotor. Referring to FIGS. 7 and 8, the outer rotor tooth profile is formed of two portions (the dashsed portions (d) of the profile and the solid line portions (the inner portions of the circles (b). The dashed portions (d) have the same profile as the tooth portions of the inner rotor tooth profile described above. The circles (b) are equal angularly spaced on a circle (a) of diameter $d_0$ where $$d_0=A+B=(n+1)B$$

The circles (b) have a diameter C (the same as the diameter of the locus circles described above). The number of circles (b) is equal to n+1.

Referring to FIG. 9, illustrating the outer rotor tooth profile, the outer rotor tooth profile has a major diameter $d_1$ given by:

$$d_1 = A + B - C + 4e$$
$$= (n + 1)B - C + 4e.$$

Similarly, the minor diameter $d_2$ of the outer rotor to the profile is given by:

$$d_2 = A + B - C$$
$$= (n + 1)B - C.$$

Thus, the profile of the outer rotor tooth profile is also given by four perameters, that is, (A, B, C, e) or (N, B, C, e) or (n, A, C, e).

As is discussed above, if the trochoidal dimensions are not selected properly, the inner rotor tooth profile has duplicate portions or edge portions as illustrated in FIGS. 1 and 2, thereby promoting wear and deterioration of pump performance. The present invention overcomes this problem by eliminating the duplicate portion or edge portion.

FIG. 10 illustrated an inner rotor rotatively assembled in an outer rotor.

In the inner gear rotor of the invention for the rotary gear pump utilizing the trochoidal (epitrochoidal) curve, when the inner rotor has a cross section perpendicular to the rotational axis defining an epitrochoidal envelope which has trochoidal dimensions wherein the base circle diameter is represented by A mm, the rolling circle diameter by B mm, the diameter of rotary path by C mm, the eccentricity by e mm, an eccentricity ratio by $f_e=e/B$, a ratio of rotary path by $f_c=C/B$, a ratio of base circle by n=A/B, a minor diameter of the inner rotor by $d_4$, and the number of the teeth of inner rotor by $n_i$, and $$K_o=(A/B+1)\times|B-2e|$$

and $$K_1=(n+1)\times|1-2f_e|$$

are given, the trochoidal dimensions are selected to satisfy the following inequality or equality: $C/K_o \leqq 1.1$ or $f_c/K_1 \leqq 1.1$, or further the tooth member $n_i$ of the inner rotor is given by the integer near $d_4/2e$, whereby the rotor of the invention creates no duplicate portion and edge portion, thus requiring no correction.

Also, in this invention, the value of $C/K_o$, even when not made 1.0 or less, is allowed to approach 1.1, so that an amount of correction, even if needed, can be reduced, the correction amount depending on the method of selection of the number of teeth and being reducible by setting the tooth number $n_i$ of the inner rotor equal to an integer near $d_4/2e$, for example, rounding up fractions 5/10 or greater and rounding down fractions 4/10 or less.

Next, an example of the invention will be concretely described. Example

Figure 2A:
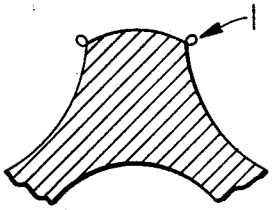
FIGS. 2A, 2B and 3C are partially enlarged views showing an inner tooth form of a conventional rotor.
Figure 2B:
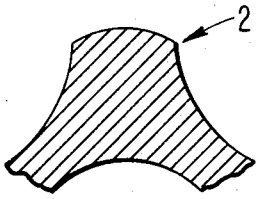
Figure 3A:
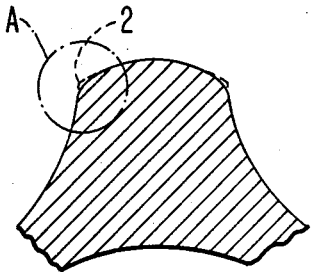
FIG. 3B is a partially enlarged view of a portion A in FIG. 3A.
Figure 3B:
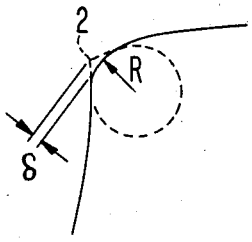
Figure 3C:
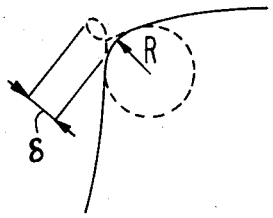

The conventionally marketed rotor utilizing the trochoidal curve has a ratio $\alpha$ of $C/K_o$ or $f_c/K_1$, for example, as shown in Table 1, the ratio $\alpha$ being such that the duplicate portion or edge portion as shown in FIGS. 2A and 2B are not avoided. Hence, the correction as shown in FIGS. 3(I), 3-(II) and 3-(III), even though different in extent, has always been carried out. In Table 1, "$\phi$23" and "$\phi$40" represent the outer diameters of the outer rotors being 23 mm. and 40 mm., respectively.

TABLE 1

| | Dimension | | | | | |
|---|---|---|---|---|---|---|
| Item | $d_4/2e$ | $n_i$ | K· | C | $\alpha$ | $\delta$ |
| $\phi$23 | 5.976 | 7 | 2.16 | 4.34 | 2.01 | 0.03~0.05 |
| $\phi$40 | 3.345 | 4 | 18.60 | 22.24 | 1.20 | 0.01~0.03 |

Figure 4A:
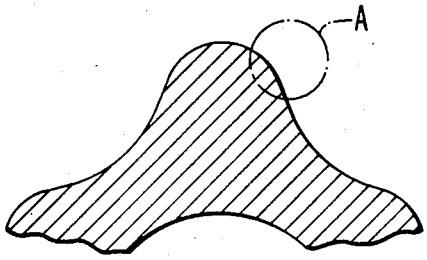
FIG. 4A is a partially enlarged view of an inner tooth form of a rotor of the invention.
Figure 4B:
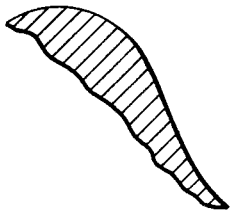
FIG. 4B is an enlarged view of a portion A in FIG. 4A.

Accordingly, the invention has selected the trochoidal dimensions of the ratio $\alpha \leqq 1$ for $C/K_o$ as $\phi$40 in Table 2 and $n_i$ as the integer nearest $d_4/2e$, then the inner rotor tooth form, as shown in FIG. 4A and in FIG. 4B of the enlarged view of portion $\alpha$, has created no duplication, whereby a smooth tooth form has been obtained.

Figure 5A:
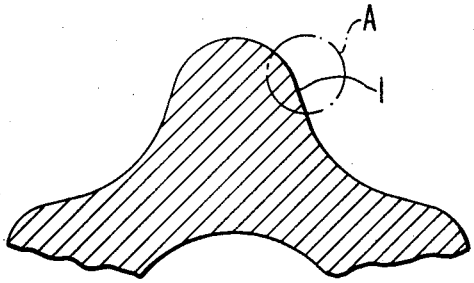
FIG. 5A is a partially enlarged view of a modified embodiment of the invention.
Figure 5B:
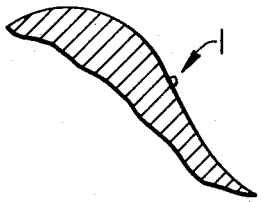
FIG. 5B is an enlarged view of a portion A in FIG. 5A.

Also, if a is selected greater than 1 as for example, for $\phi$23 shown in Table 2, and the integer near $d_4/2e$ has been selected as $n_i$, the resulting is that the duplicate portion is extremely diminished to an extent of being quite negligible as shown in FIGS. 5A and 5B. The contact bearing stress (Hertz stress) in this case has been not so extreme.

TABLE 2

| | Dimensions | | | | | |
|---|---|---|---|---|---|---|
| Item | $d_4/2e$ | $n_i$ | K· | C | $\alpha$ | $\delta$ |
| $\phi$23 | 5.976 | 6 | 4.01 | 4.05 | 1.01 | 0 |
| $\phi$40 | 3.346 | 3 | 15.93 | 14.50 | 0.91 | 0 |

What is claimed is:

1. An inner gear rotor for use in a rotary gear pump with an outer gear rotor with the inner gear rotor eccentrically rotatably mounted in the outer rotor, said inner gear rotor having an outer surface whose cross section perpendicular to the rotational axis is an epitrochoidal envelope determined utilizing the epitrochoidal curve, said inner gear rotor having trochoidal dimensions defined by a base circle of diameter A, a rolling circle of diameter B, a rotary path of diameter C, an eccentricity of length e, an eccentricity ratio $f_e=e/B$, a rotary path ratio $f_c=C/B$, a base circle ratio $n=A/B$, an inner rotor minor diameter $d_4$, a number $n_i$ of teeth, and a quantity $K_1=(n+1)\times|1-2f_e|$; said dimensions for said inner gear rotor being such that $f_c/K_1 \leqq 1.1$.

2. The inner gear rotor as in claim 1 wherein $f_c/K_1 \leqq 1.1$.

3. The device as in claim 2 wherein the number $n_i$ of teeth of said inner gear rotor is equal to the integer nearest to $d_4/2e$.

4. The inner gear rotor as in claim 1 wherein the number $n_i$ of teeth of said inner gear rotor is equal to the integer nearest to $d_4/2e$.

5. An inner gear rotor for use in a rotary gear pump with an outer gear rotor with the inner gear rotor eccentrically rotatably mounted in the outer rotor, said inner gear rotor having an outer surface whose cross section perpendicular to the rotational axis is an trochoidal envelope determined utilizing the trochoidal curve, said inner gear rotor having trochoidal dimensions defined by a base circle of diameter A, a rolling circle of diameter B, a rotary path of diameter C, an eccentricity of length e, an eccentricity ratio $f_e=e/B$, a rotary path ratio $f_c=C/B$, a base circle ratio $n=A/B$, an inner rotor minor diameter $d_4$, a number $n_i$ of teeth, and a quantity $K_1=(n+1)\times|1-2f_e|$; said dimensions for said inner inner gear rotor being such that $f_c/K_1 \leqq 1.1$.

6. The inner gear rotor as in claim 5 wherein $f_c/K_1 \leqq 1$.

7. The inner gear rotor as in claim 6 wherein the number $n_i$ of teeth of said inner gear rotor is equal to the integer nearest to $d_4/2e$.

8. The inner gear rotor as in claim 5 wherein the number $n_i$ of teeth of said inner gear rotor is equal to the integer nearest to $d_4/2e$.

* * * * *